United States Patent [19]

Stafford

[11] Patent Number: 4,892,145

[45] Date of Patent: Jan. 9, 1990

[54] WELL CASING CLEANING ASSEMBLY

[76] Inventor: Lawrence R. Stafford, 3905 Starwood La., Bakersfield, Calif. 93309

[21] Appl. No.: 348,905

[22] Filed: May 8, 1989

[51] Int. Cl.[4] ..... E21B 37/00

[52] U.S. Cl. ..... 166/171; 166/174

[58] Field of Search ..... 166/171, 173, 174, 170, 166/311, 312; 15/104.16, 104.17, 104.15

[56] References Cited

U.S. PATENT DOCUMENTS

| | | | |
|---|---|---|---|
| 2,212,784 | 8/1940 | McCune | 166/171 |
| 2,213,926 | 9/1940 | Brandel | 166/171 |
| 2,224,412 | 12/1940 | Smith | 166/171 |
| 2,233,930 | 3/1941 | Witt | 166/63 X |
| 2,464,669 | 3/1949 | Brown | 166/171 X |
| 2,960,709 | 11/1960 | Peaker et al. | 166/171 |
| 3,163,227 | 12/1964 | Caldwell | 166/171 X |
| 4,671,355 | 6/1987 | Strange | 166/171 |

*Primary Examiner*—Hoang C. Dang

*Attorney, Agent, or Firm*—I. Michael Bak-Boychuk

[57] ABSTRACT

A well casing cleaning assembly includes a cylindrical mandrel in which a spiral arrangement of transverse drillings is formed each of the drillings receiving a coiled spring intermediate the bases of exteriorly projecting knife blades. A set of arcuate plate segments, provided with vertical slots at each of the drillings, is then secured to the exterior of the mandrel compressing the springs and exposing the blade ends. An upper and lower packing on the mandrel then confines pressurized cleaning fluid.

5 Claims, 2 Drawing Sheets

WELL CASING CLEANING ASSEMBLY

BACKGROUND OF THE INVENTION

1. Field of the Invention

The present invention relates to well perforation assemblies, and more particularly to a cleaning assembly useful in opening well perforations.

2. Description of the Prior Art

In a typical well bore through which fluids are drawn from an underground formation cylindrical well casings are often used which at one or more levels are perforated. As the fluids migrate through the formation to the well bore large quantities of particulate matter are carried along. This particulate matter eventually consolidates around the perforations, finally closing off any flow therethrough.

As a consequence those engaged in the well business have devised in the past a variety of tools which in one way or another reopen the perforation. Some examples of such prior tools are described in U.S. Pat. Nos. 2,464,669 to Brown, 2,233,930 to Witt; 2,213,926 to Brandel; 2,212,784 to McCune; and 3,163,227 to Caldwell. Each of these, while suitable for their purposes, attend to the specific concern at hand.

A perforation cleaning arrangement which localizes the volume exposed to pressure is therefore a desirable mechanism in this setting and it is one such arrangement that is disclosed herein.

SUMMARY OF THE INVENTION

Accordingly, it is the general purpose and object of the present invention to provide a well bore cleaning assembly conformed to localize pressurized cleaning fluids.

Other objects of the invention are to provide a well perforation cleaning assembly in which the perforation tools are stacked to a maximum density.

Yet further objects of the invention are to provide a well cleaning assembly which is convenient in fabrication and in maintenance.

Briefly, these and other objects are accomplished within the present invention by providing a substantially cylindrical mandrel perforated with a plurality of diametric drillings arranged along a diametric spiral over the length of the mandrel. Each of the drillings is conformed to receive a coiled spring aligned between two spring caps, each cap opposing a circular base of a pointed knife blade. Thus the expansion of each of the springs radially urges the knife blades of the respective drillings.

A tubular shroud comprising a plurality of adjacent arcuate segments is then engageable to the exterior of the cylindrical mandrel including a spiral arrangement of vertical slots aligned over the corresponding drillings. The segments of this shroud may be secured to the mandrel by threaded fasteners and as the fasteners are brought in the springs are compressed therebetween impressing across the caps at their ends a spring bias to each knife base.

In this manner a spring bias is effected for each knife blade extending through the slots in the shroud.

A plurality of vertical grooves or depressions are then formed on the mandrel surface at each end of a drilling. These grooves and the length of the corresponding slots in the shroud allow for pivotal collapse of each knife blade as the tool is passed into the well.

Once the tool reaches the well level at which the casing is perforated those collapsed blades aligned over a perforation are then extended, fracturing any coalesced matter therein. Concurrently, liquid at pressure is conveyed to the mandrel to emerge through the slots washing out the loosened debris. This conveyed pressurized liquid is confined in the well bore to an axial dimension set by an upper and lower packing at the mandrel ends.

One will note that the doubling of the blades at each drilling cuts the effective axial dimension of the mandrel in half. Thus, the pressurized liquid is confined to a much smaller well segment, increasing the net pressure at each perforation. In this manner an optimized, easily fabricated tool is devised which further obtains convenience in use and in maintenance.

DESCRIPTION OF THE PREFERRED EMBODIMENT

Figure 1:
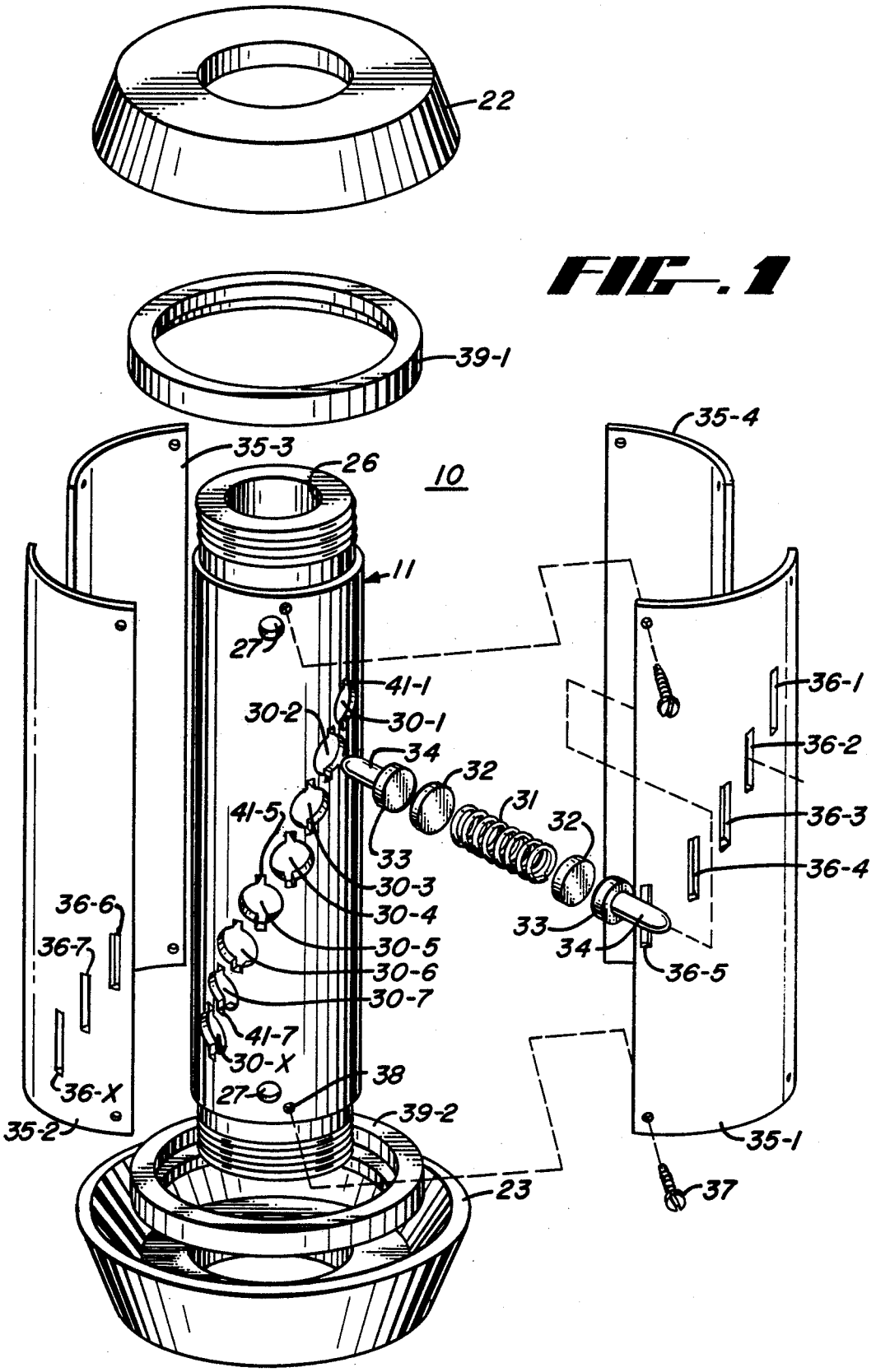
FIG. 1 is a perspective illustration, separated by parts, of the inventive well cleaning assembly.
Figure 2:
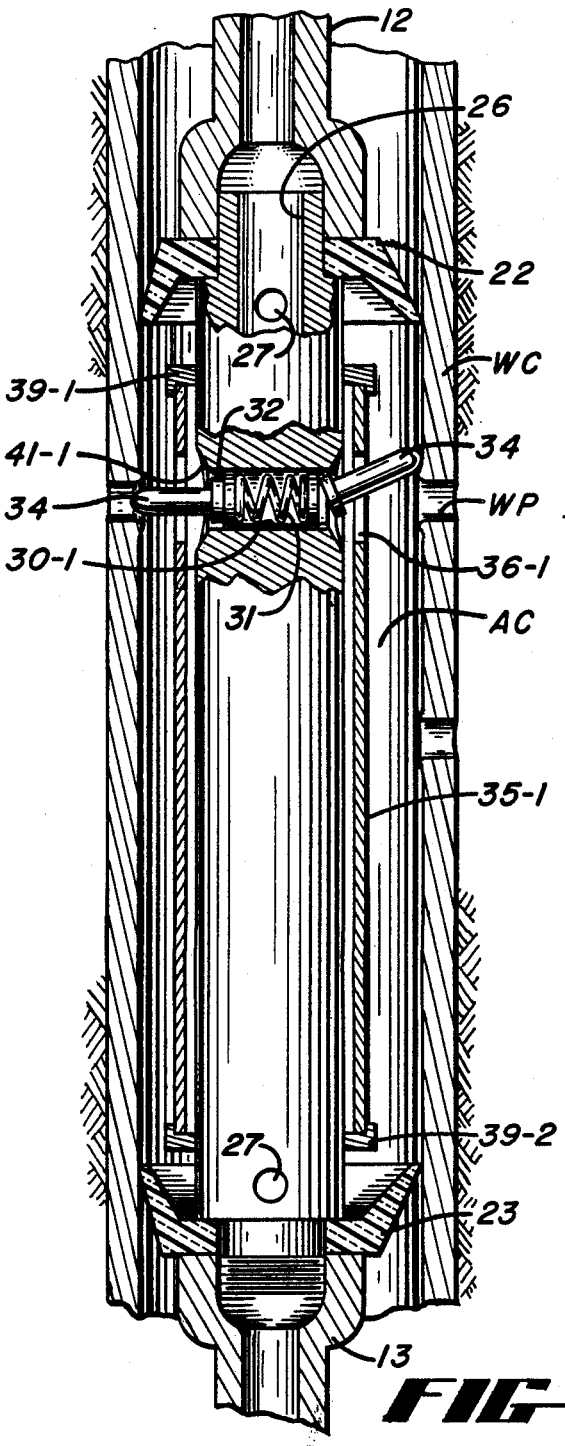
FIG. 2 is a side view, in section, of the assembly shown in FIG. 1.
Figure 3:
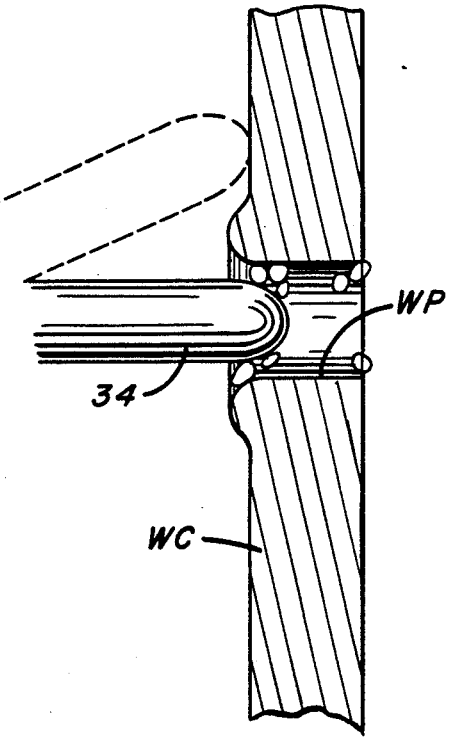
FIG. 3 is a side view detail of a blade point extending into a well perforation.

As shown in FIGS. 1–3 the inventive assembly, generally designated by the numeral 10, comprises a substantially cylindrical mandrel 11 connected between an upper thimble assembly 12 and a lower thimble assembly 13. Thimble assemblies 12 and 13 each include a corresponding chevron packing 22 and 23 conformed to the interior of well casing WC. In this form an annular cavity AC is defined within the well casing WC between the upper and lower packings. Fluid at pressure is then conveyed through a pipe string from the well top (not shown) into a bypass pit 26 at the ends of the mandrel to pass into the annular cavity AC through various fluid openings 27.

A plurality of diametric drillings 30-1 through 30-x are then formed in the mandrel arranged at azimuth alignments in a spiral along the mandrel axis. Each of the drillings 30-1 through 30-x receives a corresponding coiled spring 31 confined between spring caps 32 which then each oppose a circular cap 33 at the base of a knife blade 34. The combined stacked dimension of spring 31, its caps 32, and the knife caps 33 is greater than the axial dimension of the drillings 30-1 through 30-x. When received in this stacked arrangement the foregoing are compressed by vertically segmented arcuate plates 35-1 through 35-4 each of which is provided with a spiral of elongate slots 36-1 through 36-x. The spiral alignment of slots 36-1 through 36-x coincides with the spiral alignment of the axes of drillings 30-1 through 30-x once the plates are brought in position. When thus aligned a plurality of threaded fasteners 37 are then advanced into threaded openings 38 formed in the mandrel to compress the springs and the knives. An upper and a lower retaining ring 39-1 and 39-2 is then fixed over the assembled plates and fastened for an integral assembly.

As thus assembled the knife blades 34 extend through their corresponding slots 36-1 through 36-x to a dimension greater than the sectional dimension of the well casing WC. Accordingly, in the course of passage through the well bore, the knife blades are collapsed into their corresponding slots therebeing further collapse relieving depressions 41-1 through 41-x at the ends of each drilling.

Once the assembly 10 is brought to the level at which the well casing is perforated with perforations WP then the spring bias at each blade will extend those blades aligned with the perforations. Pressurized fluid is then passed through the pipe string to complete the cleaning.

In this form the number of projecting knife blades is effectively doubled, thus cutting the vertical dimension between the packings substantially in half. This increases the effectiveness of the pressurized fluid in an assembly which is easily fabricated and maintained.

Obviously many modifications and changes are made to the foregoing without departing from the spirit of the invention. It is therefore intended that the scope of the invention should be determined solely on the claims appended hereto.

What is claimed is:

1. A well casing cleaning assembly, comprising:

a cylindrical mandrel including a plurality of diametric drillings extending thereacross said drillings being aligned at incremental azimuth displacements relative each other to form a spiral alignment;

a corresponding plurality of knife blade assemblies received in said drillings each said knife blade assembly including a coiled spring and a first and second knife blade extending from a base cap at one end thereof, said base caps abutting the ends of said coiled spring;

a plurality of arcuate plate segments engageable to the exterior of said mandrel said arcuate plate segments including slots formed therein in alignment over said drillings for receiving corresponding ones of said knife blades therethrough;

an upper and a lower packing attached to the ends of said mandrel and conformed for receipt in said well casing.

2. Apparatus according to claim 1 wherein:

said mandrel further includes fluid conveying means for conveying fluids therethrough.

3. Apparatus according to claim 2 further comprising:

a plurality of spring caps interposed between said coiled spring and said base caps.

4. Apparatus according to claim 1 wherein said arcuate plate segments are attached to said mandrel by way of threaded fasteners, for compressing said coil spring therebetween.

5. Apparatus according to claim 4 wherein:

said slots in said arcuate plate segments are dimensioned for pivotal motion of said knife blades therein.

* * * * *